United States Patent [19]

Krüger

[11] 4,295,807

[45] Oct. 20, 1981

[54] INTERNAL COMBUSTION ENGINE WITH OIL PUMP GEAR SURROUNDING AND DRIVEN BY CRANKSHAFT

[75] Inventor: Hermann Krüger, Wolfsburg, Fed. Rep. of Germany

[73] Assignee: Volkswagenwerk Aktiengesellschaft, Wolfsburg, Fed. Rep. of Germany

[21] Appl. No.: 59,475

[22] Filed: Jul. 20, 1979

[30] Foreign Application Priority Data

Aug. 23, 1978 [DE] Fed. Rep. of Germany ..... 2836766

[51] Int. Cl.[3] ..... F04C 2/10; F04B 17/00; F01M 1/02

[52] U.S. Cl. ..... 418/170; 123/196 R; 123/198 C; 417/362

[58] Field of Search ..... 418/167–171, 418/166, 205, 206; 417/362, 364; 123/198 C, 196 R; 184/6.5

[56] References Cited

U.S. PATENT DOCUMENTS

| | | | |
|---|---|---|---|
| 1,537,013 | 5/1925 | Jeffers | 184/6.5 |
| 2,328,296 | 8/1943 | Ritter | 184/6.5 |
| 3,165,066 | 1/1965 | Phelps et al. | 418/171 |
| 3,217,978 | 11/1965 | Harlin | 184/6.5 |
| 3,407,741 | 10/1968 | Weber et al. | 418/166 |

FOREIGN PATENT DOCUMENTS 1576345 2/1970 Fed. Rep. of Germany .

*Primary Examiner*—John J. Vrablik

*Attorney, Agent, or Firm*—Brumbaugh, Graves, Donohue & Raymond

[57] ABSTRACT

An internal combustion engine having a rotating crankshaft mounted on at least one main bearing is provided with an oil pump having at least one gear surround the crankshaft and rotationally driven by the crankshaft. The pump gear surrounds the main bearing so that the main bearing and the oil pump occupy a common axial space on the crankshaft.

8 Claims, 3 Drawing Figures

INTERNAL COMBUSTION ENGINE WITH OIL PUMP GEAR SURROUNDING AND DRIVEN BY CRANKSHAFT

BACKGROUND OF THE INVENTION

The present invention relates to internal combustion engines having a rotating crankshaft mounted on a main bearing and an oil pump which is driven by the crankshaft. In particular, the invention relates to engines having an oil pump which is a rotary pump having one or two gears located in the same plane and surrounding the crankshaft.

It has been known to provide internal combustion engines with oil pumps that are either indirectly driven, thus adding to the overall bulk, weight, number of parts and inaccessibility of primary engine parts, or to increase the length of the crankshaft and provide a rotary type oil pump of the type described in German Offenlegungsschrift No. 1,576,345. This latter type of oil pump adds to the length of the overall engine and to the bulk and weight of the engine by the necessary crankshaft extension required to add the oil pump.

It is therefore an object of the present invention to provide a new and improved oil pump which eliminates the need for an indirectly driven oil pump mounted on the engine.

It is a further object of the invention to provide a new rotary style oil pump capable of being driven by the rotation of the crankshaft which eliminates the need for an extension of the crankshaft and thus creates an internal combustion engine of shorter structural length and lighter weight than heretofore known in the art.

SUMMARY OF THE INVENTION

In accordance with the present invention there is provided an internal combustion engine having a crankshaft mounted on a main bearing and an oil pump which consists of 1 or 2 gears which surround the crankshaft and are driven by the crankshaft. The configuration of the oil pump is characterized by the gear(s) being located directly radially outward from the main bearing thereby causing the oil pump to occupy the same axial space on the crankshaft as the main bearing.

In a preferred embodiment it is also provided that the oil pump is situated in a housing which has a cylindrical zone wherein the crankshaft main bearing is located. The gear(s) of the oil pump surround the cylindrical zone of the housing and is driven by means of at least one rigid connection between the end face of the adjacent crank web and a gear of the oil pump.

The present invention is further enhanced when the crankshaft main bearing is an external bearing located in a cylindrical zone of the oil pump housing, which has cylindrical extension for lodging a crankshaft seal. Immediately after the oil pump housing in the outward axial direction is provided a pulley for operating a fan and a water pump, which pulley is recessed in the axial direction so that the oil pump housing extension may be received into that recess. Additionally, the oil pump housing contains oil ducts which are arranged in projecting portions of the housing which surround the pulley at a radial distance therefrom.

Another preferred configuration would provide that the oil duct projections of the oil pump housing be located in the axially extending recess of the pulley.

This would eliminate projections from the engine external to the main crankshaft/pulley protuberance.

For a better understanding of the present invention, together with other and further objects, reference is made to the following description, taken in conjunction with the accompanying drawing, and its scope will be pointed out in the appended claims.

DESCRIPTION OF THE INVENTION

Figure 1:
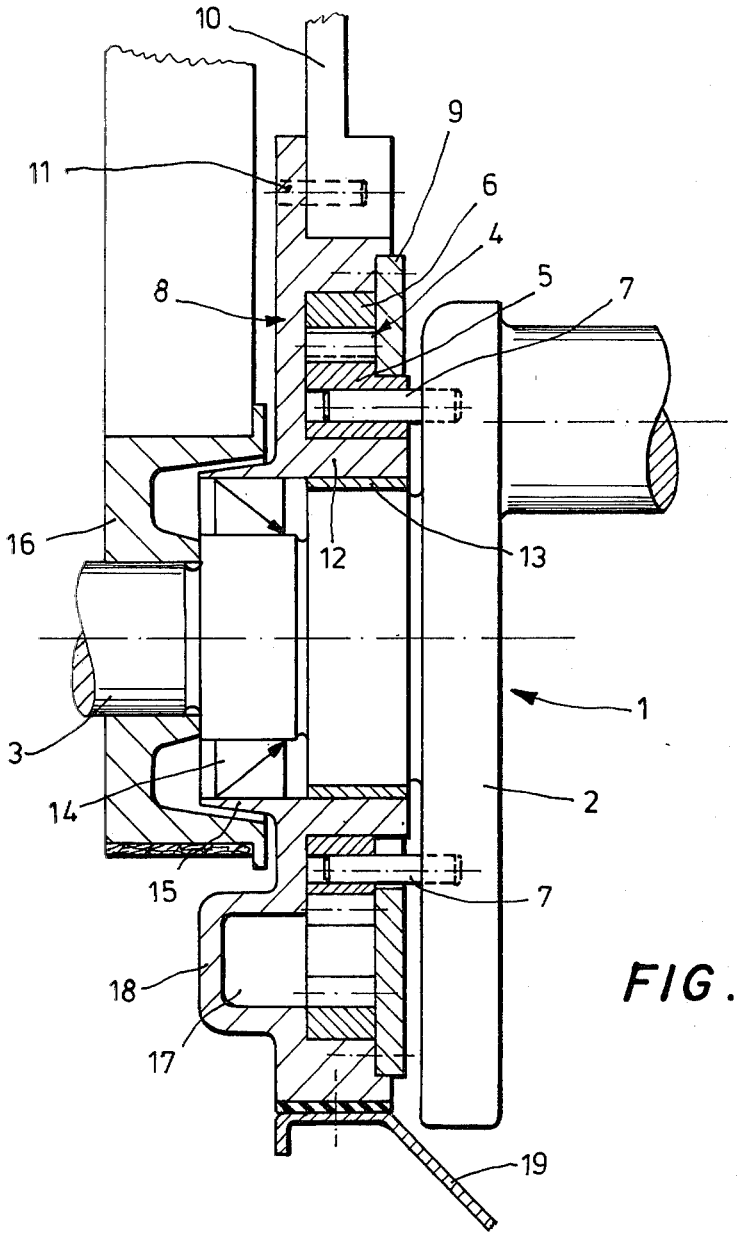
FIG. 1 is a longitudinal section through the portion of an engine illustrating an oil pump arrangement in accordance with the present invention.

Referring to the figure there is shown, in longitudinal section, the pertinent portions of the engine wherein the crankshaft 1 is mounted for rotation on the main bearing 13 of the engine. Of particular importance in this invention are the outer crank web 2, of the crankshaft, and the crankshaft main bearing pin 3. In the example shown, the oil pump 4 is constructed as a rotary pump having a gear 5 which has outside toothing that meshes in a planetary fashion with the inner toothing of a gear 6. The innermost gear 5 is driven by means of the rigid driver bolts 7 which connect the gear 5 to the outer face of crank web 2.

The oil pump 4 has a housing 8 which together with housing cover 9 forms a lodging for the two gears 5 and 6 and constitutes a component of the crankcase 10 to which the housing 8 is secured by means of a screw 11. Other forms of securing the oil pump housing 8 to the crankcase 10 are obviously available, such as by an attachment which is perpendicular to the crankshaft axis.

The pump housing 8 has a center cylindrical portion 12 which carries the crankshaft main bearing 13 within its inside surface and supports the gears 5 and 6 of the oil pump on its outer surface so that the main bearing and the oil pump are arranged in a single plane. This configuration eliminates completely the need for an extension of crankshaft pin 3 in order to mount the oil pump.

The oil pump housing 8 also has an extension 15 directed axially outward in order to accommodate the crankshaft seal 14. Pulley 16 is arranged on the crankshaft pin 3 immediately after the extension 15 of the housing and has a recess into which extension 15 projects. This eliminates the need for an axial extension of the crankshaft 1 and its pin 3 in order to house the crankshaft seal 14.

In the embodiment shown herein, delivery 21 and drainage 22 ducts for the oil are provided in the pump housing 8 by means of projecting portions 18 in the pump housing which accommodate the ducts such as the duct 17 shown within projection 18. This configuration required the projecting portion 18 of the housing 8 to be located at a radial distance from the pulley 16 so that the belt associated with the pulley can be assembled without difficulty and its operation not be impaired. The oil pump housing 8 will also have connected to it, as usual, the oil pan 19.

Figure 2:
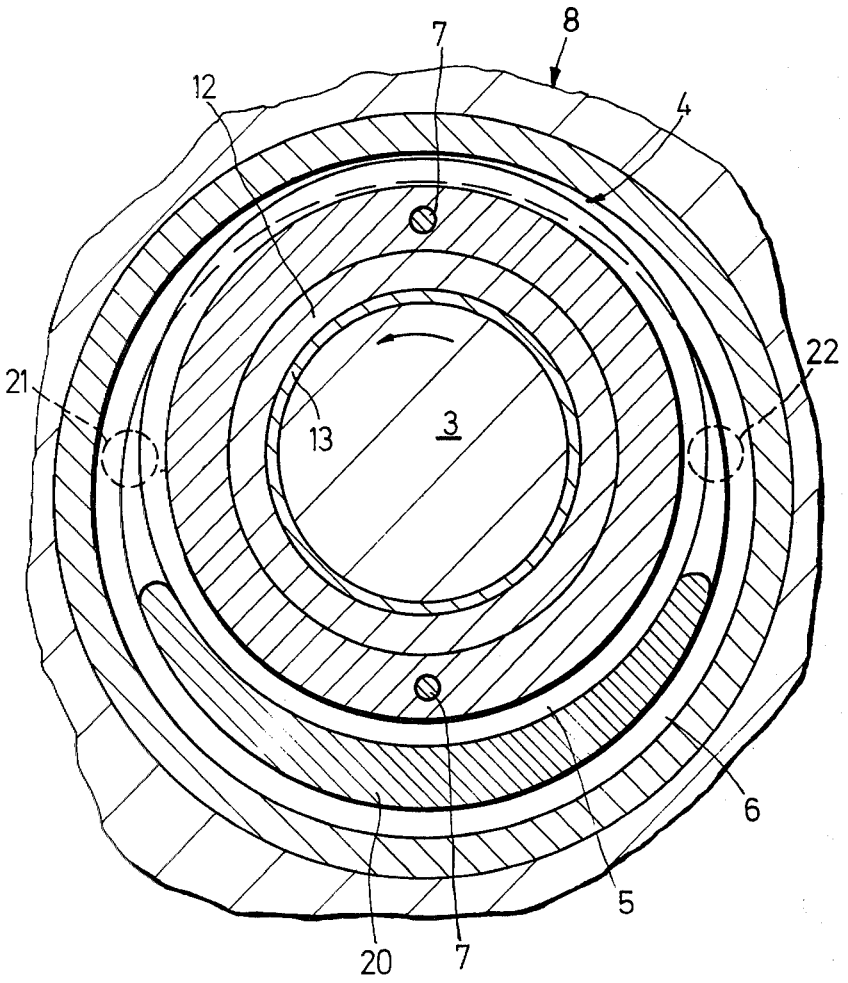
FIG. 2 is a cross sectional view of the embodiment shown in FIG. 1.

The operation of the oil pump 4 is best seen in connection with FIG. 2. Gear 5 is driven by means of rigid driver bolts 7 which connect the gear 5 to the outer face of the crank web 2 for rotation in a torsion-resistant manner. As the innermost gear 5 rotates in the direction indicated by the arrow, its outer teeth mesh in an epicyclic fashion with the inner teeth of the fixed, outermost gear 6. The space between the gears 5 and 6 opposite the point where the gears mesh is indicated generally as zone 20. As the gears rotate, the area immediately ahead of zone 20 in the direction of movement contains oil flowing toward and out of the oil drainage duct 22. In the area immediately behind zone 20, oil enters into the oil pump through oil delivery duct 21, the oil being squeezed toward the drainage duct 22 as the gears 5 and 6 increasingly mesh.

Figure 3:
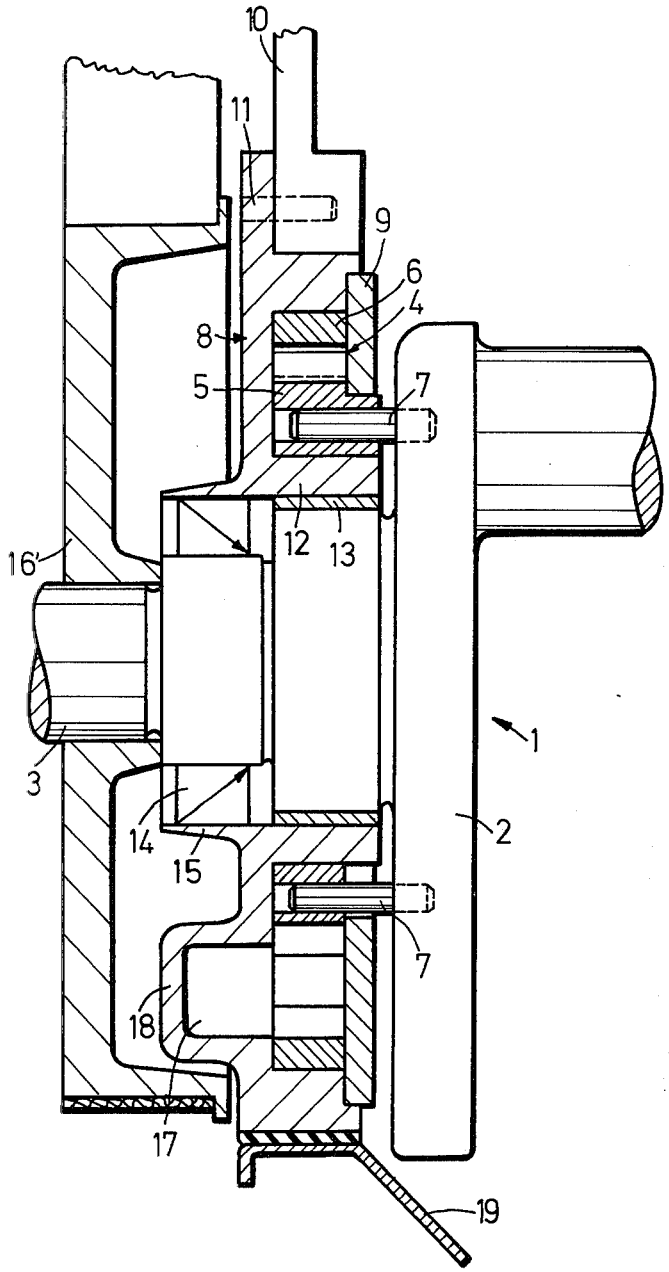
FIG. 3 is a longitudinal section through the portion of an engine illustrating an oil pump arrangement in accordance with another embodiment of the present invention.

In another configuration of the present invention, shown in FIG. 3, the pulley 16' would be provided with a recess having an inner diameter which would accommodate the projecting portion 18 of the oil pump housing 8.

While there have been described what are believed to be the preferred embodiments of the invention, those skilled in the art will realize that changes and modifications may be made thereto without departing from the spirit of the invention, and it is intended to claim all such changes and modifications as fall within the true scope of the invention.

I claim:

1. In an internal combustion engine having a crankshaft mounted for rotation on at least one main crankshaft bearing and having a gear oil pump directly driven by said crankshaft and including at least one gear surrounding said crankshaft and rotationally driven by said crankshaft, the improvement wherein said gear also surrounds said main bearing and forms an operative gear of said pump whereby said bearing and said oil pump occupy common axial space on said crankshaft.

2. The improvement as described in claim 1, wherein there are provided end face driving means connecting said gear to an adjacent crank web of said crankshaft.

3. The improvement as described in claim 2, wherein said end face driving means comprise driver bolts for connecting in a torsion resistent manner said gear and said adjacent crank web.

4. The improvement as described in claim 1 or 2, wherein said oil pump is a rotary pump and includes a second gear and wherein said second gear surrounds said crankshaft main bearing.

5. The improvement as described in claim 1 or 2, wherein there is provided a housing for said pump and wherein said crankshaft main bearing is arranged in a cylindrical zone of said housing and said gear surrounds said cylindrical zone.

6. The improvement as described in claim 5, wherein said crankshaft main bearing is an external bearing, wherein said oil pump housing is provided with a cylindrical extension for lodging a crankshaft seal, and wherein there is provided a pulley on said crankshaft having an axially extending recess for receiving said extension.

7. The improvement as described in claim 6, wherein said housing includes oil ducts arranged in projecting portions of said housing, said projecting portions lying at a radial distance outside said pully.

8. The improvement as described in claim 6, wherein said housing includes oil ducts arranged in projecting portions of said housing, said portions projecting into said axially extending recess of said pulley.

* * * * *